US010800165B2

(12) United States Patent
Kiuchi et al.

(10) Patent No.: US 10,800,165 B2
(45) Date of Patent: Oct. 13, 2020

(54) INKJET PRINTING APPARATUS AND INSPECTION APPARATUS

(71) Applicant: CANON KABUSHIKI KAISHA, Tokyo (JP)

(72) Inventors: Takahiro Kiuchi, Fuchu (JP); Noriko Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/295,556

(22) Filed: Mar. 7, 2019

(65) Prior Publication Data

US 2019/0299589 A1 Oct. 3, 2019

(30) Foreign Application Priority Data

Mar. 30, 2018 (JP) ..... 2018-068518

(51) Int. Cl.
*B41J 2/165* (2006.01)
*B41J 2/045* (2006.01)

(52) U.S. Cl.
CPC ..... *B41J 2/0451* (2013.01); *B41J 2/04586* (2013.01); *B41J 2/16517* (2013.01); *B41J 2/16588* (2013.01)

(58) Field of Classification Search
CPC .. B41J 2/0451; B41J 2/04586; B41J 2/16517; B41J 2/16588; B41J 2/16579
See application file for complete search history.

(56) References Cited

U.S. PATENT DOCUMENTS 8,646,872 B2 * 2/2014 Jo ..... B41J 2/1721 347/35
2004/0135843 A1 * 7/2004 Hayakawa ..... B41J 2/16508 347/35
2009/0122106 A1 * 5/2009 Ray ..... B41J 2/165 347/35

FOREIGN PATENT DOCUMENTS

WO 2012/166089 A1 12/2012

* cited by examiner

*Primary Examiner* — Sharon A. Polk
(74) *Attorney, Agent, or Firm* — Venable LLP

(57) ABSTRACT

An inkjet printing apparatus has an inspection unit that inspects an ejection condition of multiple ejecting ports arrayed in a first direction, a motor that moves the inspection unit in the first direction, a conversion unit that reduces rotation speed obtained from the motor and converts driving force of the motor into movement of the inspection unit and a control unit that controls inspection of the ejection condition, performed by the inspection unit. The control unit controls the inspection of the ejection condition based on detection of a rotary encoder detecting rotation of the motor and a linear encoder detecting a position of the inspection unit.

17 Claims, 13 Drawing Sheets

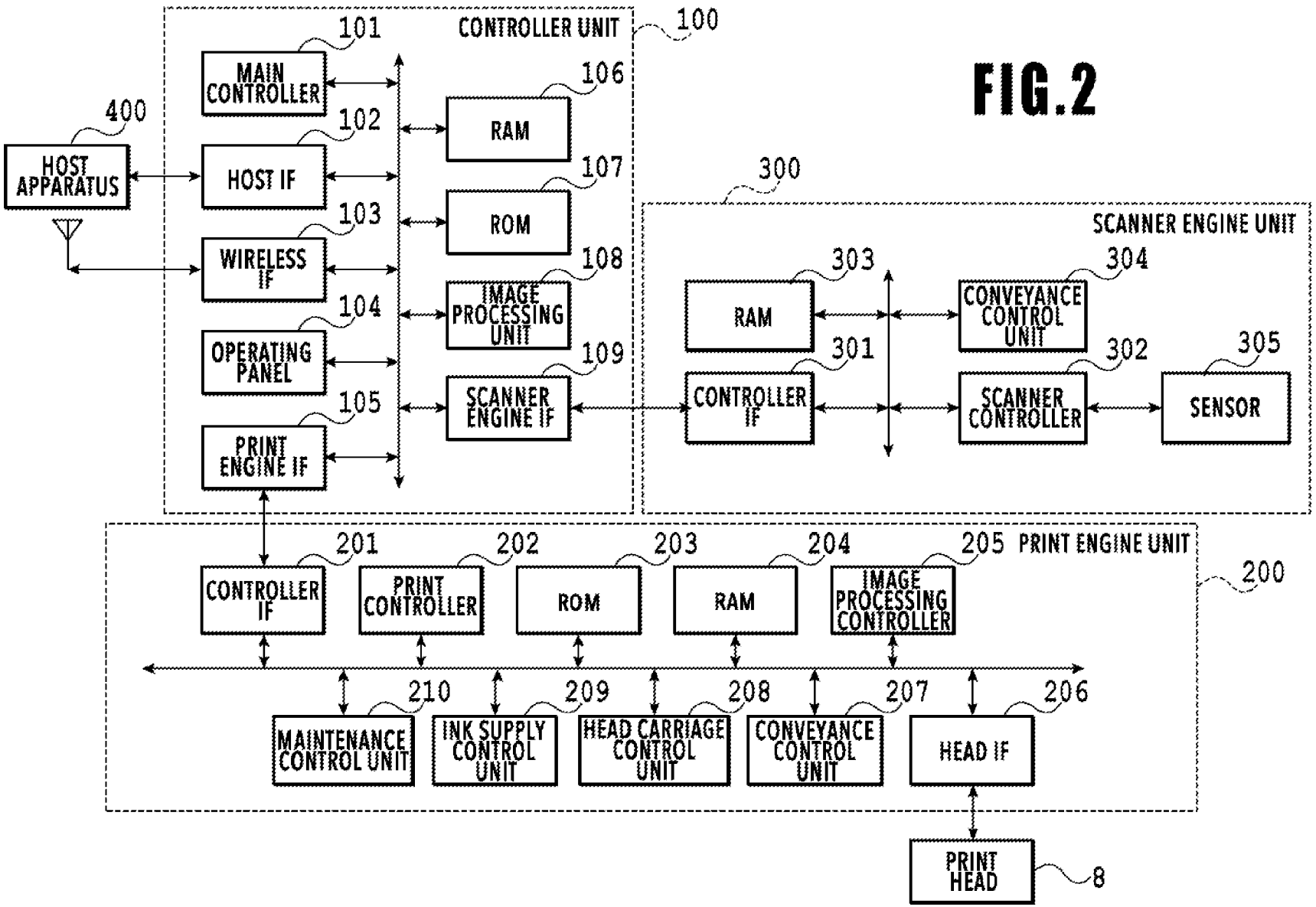
FIG.2
100
CONTROLLER UNIT
101
MAIN CONTROLLER
102
HOST IF
103
WIRELESS IF
104
OPERATING PANEL
105
PRINT ENGINE IF
106
RAM
107
ROM
108
IMAGE PROCESSING UNIT
109
SCANNER ENGINE IF
400
HOST APPARATUS
300
SCANNER ENGINE UNIT
301
CONTROLLER IF
302
SCANNER CONTROLLER
303
RAM
304
CONVEYANCE CONTROL UNIT
305
SENSOR
200
PRINT ENGINE UNIT
201
CONTROLLER IF
202
PRINT CONTROLLER
203
ROM
204
RAM
205
IMAGE PROCESSING CONTROLLER
206
HEAD IF
207
CONVEYANCE CONTROL UNIT
208
HEAD CARRIAGE CONTROL UNIT
209
INK SUPPLY CONTROL UNIT
210
MAINTENANCE CONTROL UNIT
8
PRINT HEAD

INKJET PRINTING APPARATUS AND INSPECTION APPARATUS

BACKGROUND OF THE INVENTION

Field of the Invention

The present invention relates to inkjet printing apparatuses and inspection apparatuses.

Description of the Related Art

Heads configured to eject liquid, such as inkjet print heads, require inspection of the ejection condition in some cases. International Patent Application Laid-Open No. 2012/166089 discloses a structure in which the ejection condition of multiple ejecting ports is detected sequentially while a sensor unit for detecting the presence of droplets is being moved in the direction in which the ejecting ports are arrayed. According to the disclosure in International Patent Application Laid-Open No. 2012/166089, an appropriate position detector, such as a scale and encoder (in other words, a linear encoder) is useful for associating the position of the sensor unit with the detection result.

Meanwhile, in the case of performing ejection inspection of multiple ejecting ports in parallel with the movement of the sensor unit as in International Patent Application Laid-Open No. 2012/166089, the sensor unit is required to be moved at such a low speed that an ejection inspection process can be performed in time at the position of each ejecting port. In the case of seeking to keep such a low speed stably using a linear encoder, the resolution (density) of the slits arrayed in the encoder scale is required to be sufficiently high compared to that of the ejecting ports. However, since the density of the head is now increasing, it is difficult to prepare such slits.

In summary, in the structure in which the ejection inspection process is performed while the sensor unit is being moved, it is difficult to stabilize the movement of the sensor unit at a low speed to obtain inspection results with high reliability.

SUMMARY OF THE INVENTION

The present invention has been made to solve the above problem. Thus, an object thereof is to stabilize the movement of the sensor unit at a low speed to obtain inspection results with high reliability in the structure in which the ejection inspection process is performed while the sensor unit is being moved.

According to a first aspect of the present invention, there is provided an inkjet printing apparatus comprising: a print head in which multiple ejecting ports for ejecting ink are arrayed in a first direction; an inspection unit including a sensor configured to inspect an ejection condition of the multiple ejecting ports; a motor configured to move the inspection unit in the first direction; a conversion unit configured to reduce rotation speed obtained from the motor and convert driving force of the motor into movement of the inspection unit in the first direction; a rotary encoder configured to detect rotation of the motor; a linear encoder configured to detect a position of the inspection unit along the first direction; and a control unit configured to control inspection of the ejection condition, performed by the inspection unit, based on detection of the rotary encoder and the linear encoder.

According to a second aspect of the present invention, there is provided a control method of controlling an inkjet printing apparatus including a print head in which multiple ejecting ports for ejecting ink are arrayed in a first direction an inspection unit including a sensor configured to inspect an ejection condition of the multiple ejecting ports, a motor configured to move the inspection unit in the first direction, a conversion unit configured to reduce rotation speed obtained from the motor and convert driving force of the motor into movement of the inspection unit in the first direction, a rotary encoder configured to detect rotation of the motor, and a linear encoder configured to detect a position of the inspection unit along the first direction, the control method comprising a control step of controlling inspection of the ejection condition, performed by the inspection unit, based on detection of the rotary encoder and the linear encoder.

According to a third aspect of the present invention, there is provided an inspection apparatus that inspects an inspection target while moving an inspection unit including a sensor for inspection relative to the inspection target extending in a first direction, comprising: a motor configured to move the inspection unit in the first direction; a conversion unit configured to reduce rotation speed obtained from the motor and convert driving force of the motor into movement of the inspection unit in the first direction; a rotary encoder configured to detect rotation of the motor; a linear encoder configured to detect a position of the inspection unit along the first direction; and a control unit configured to control inspection of the inspection target, based on output of the rotary encoder and the linear encoder.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

DESCRIPTION OF THE EMBODIMENTS

Figure 1:
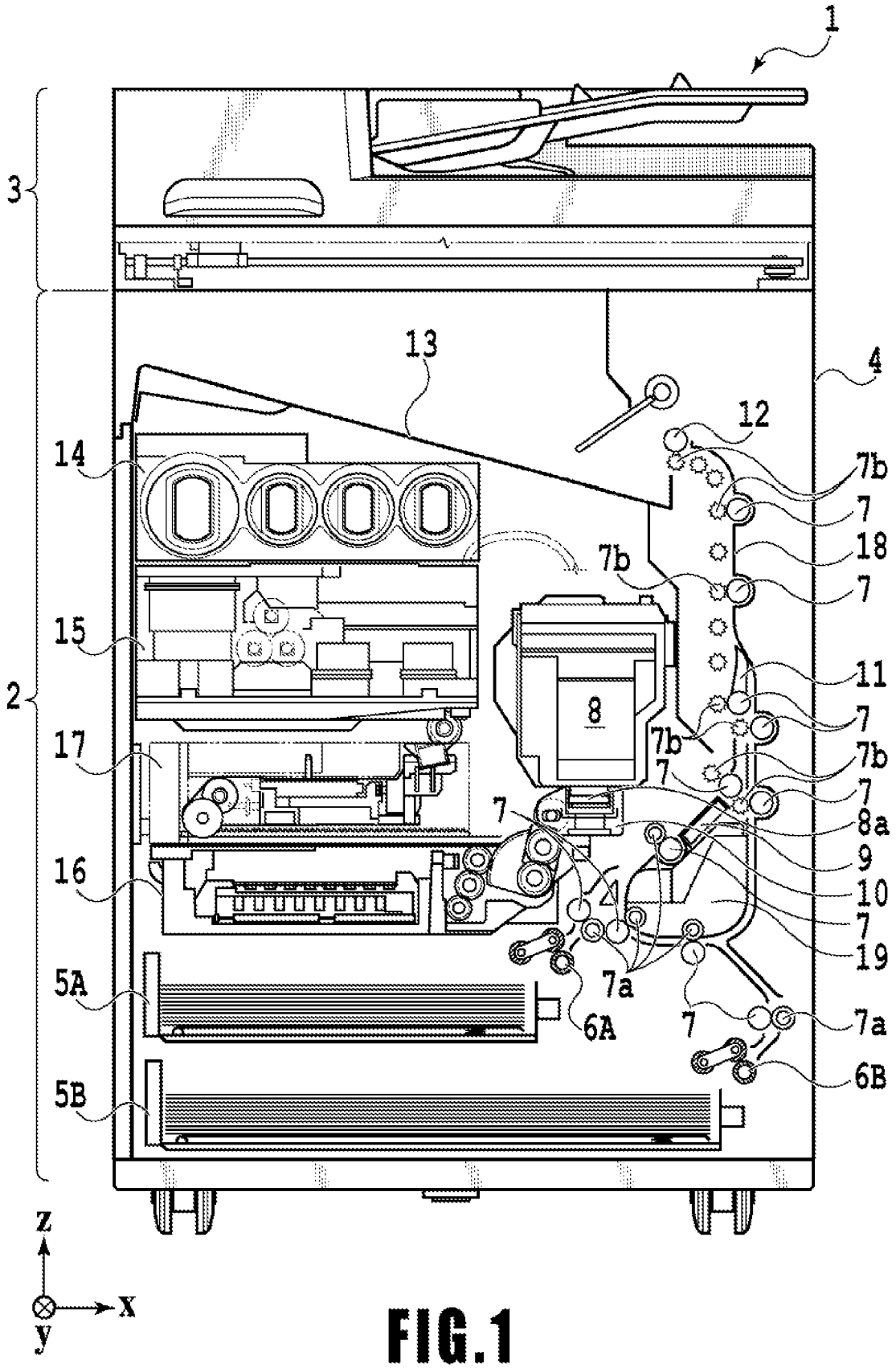
FIG. 1 is a diagram illustrating a printing apparatus in the standby state.

FIG. 1 is an internal configuration diagram of an inkjet printing apparatus 1 (hereinafter "printing apparatus 1")

used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform a print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
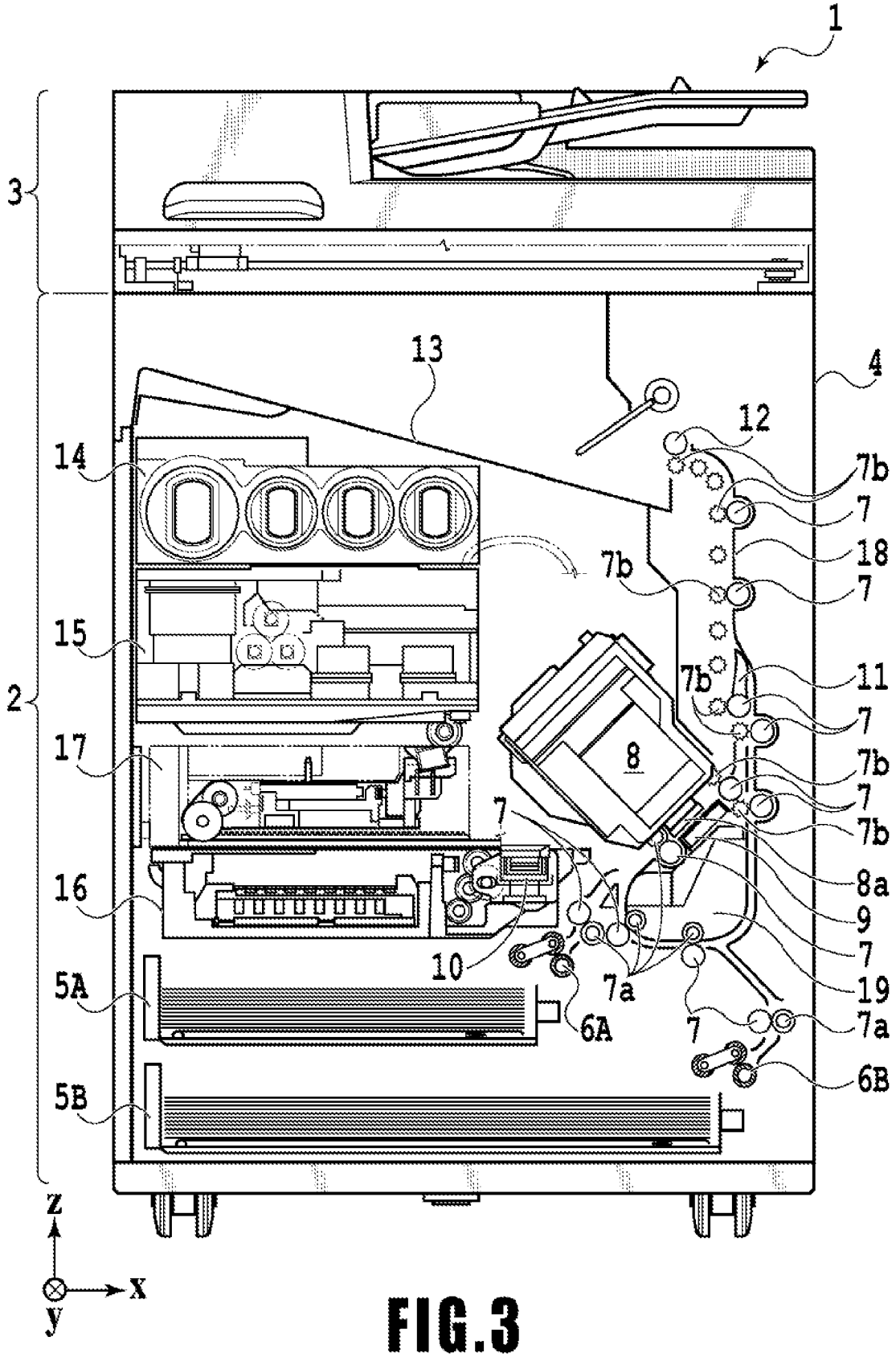
FIG. 3 is a diagram illustrating the printing apparatus in the printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
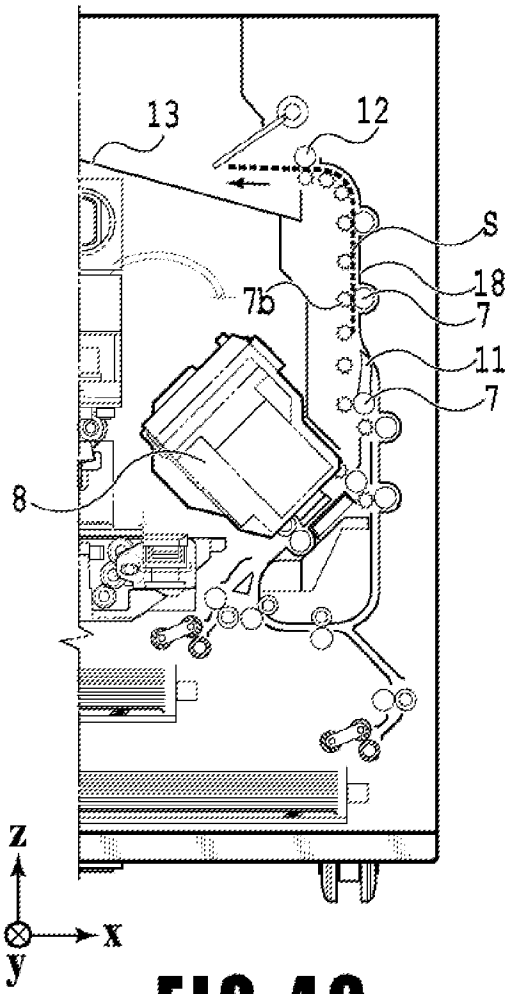
FIGS. 4A to 4C are diagrams illustrating the conveyance path of a print medium fed from a first cassette.
Figure 4B:
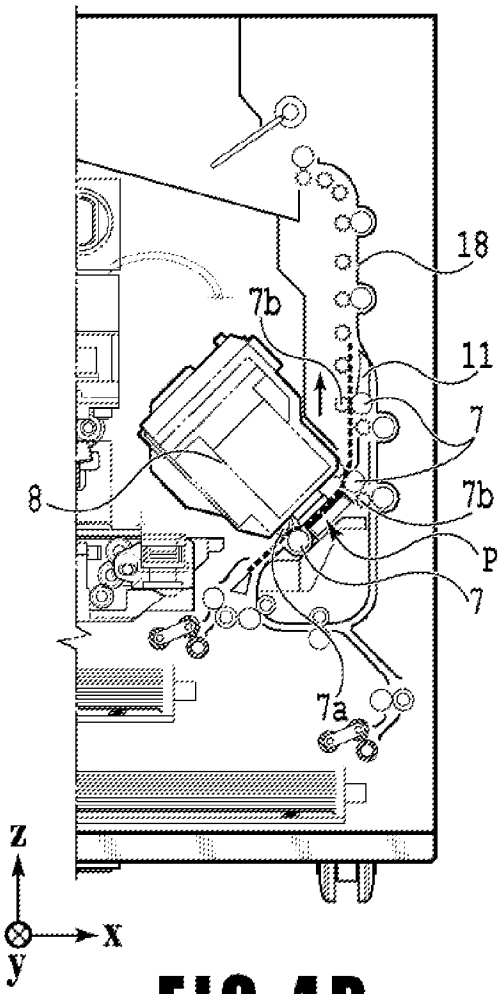
Figure 4A:
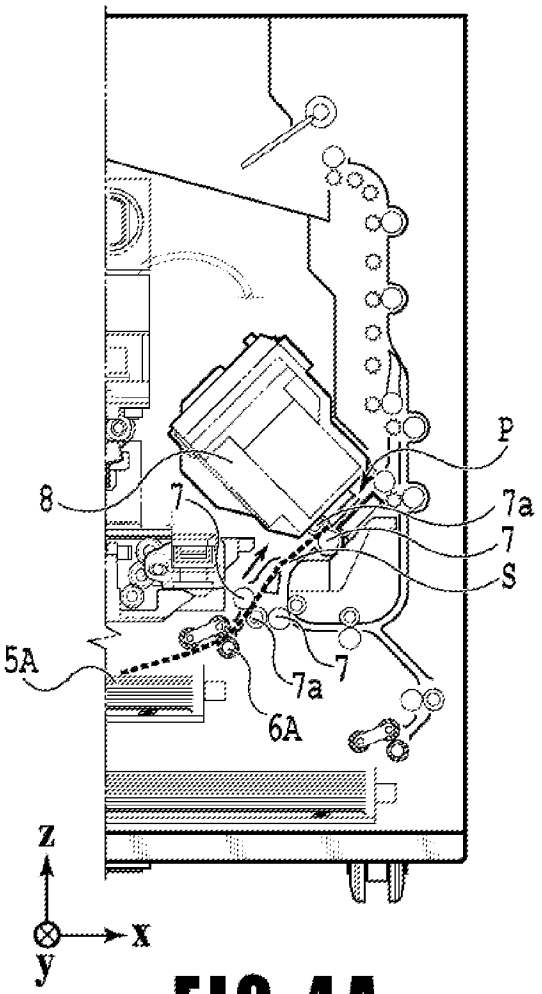

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
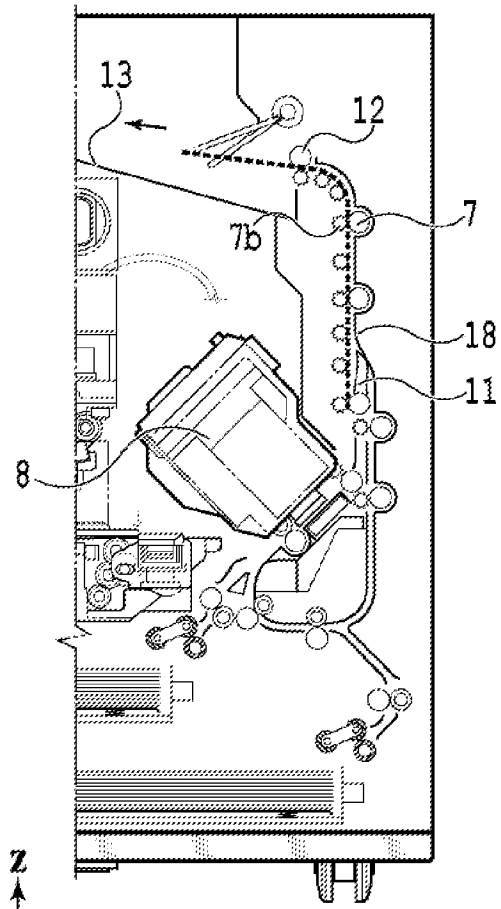
FIGS. 5A to 5C are diagrams illustrating the conveyance path of a print medium fed from a second cassette.
Figure 5B:
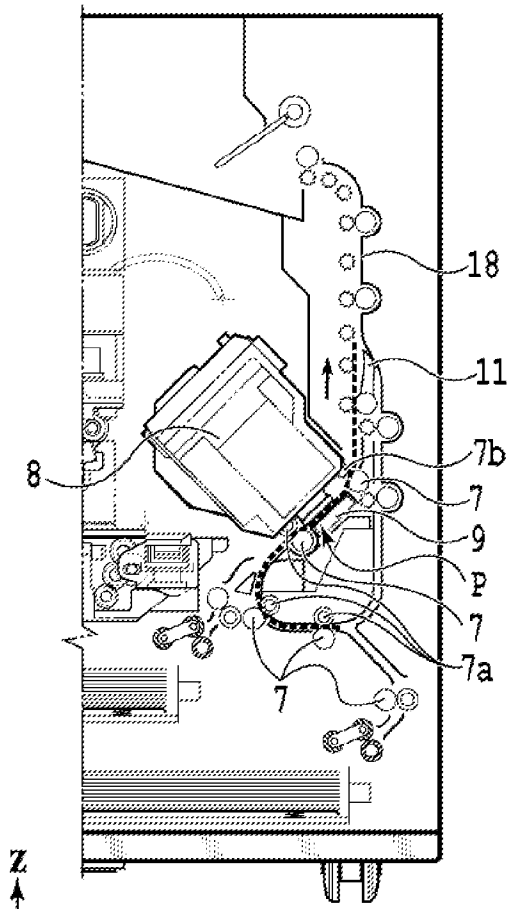
Figure 5A:
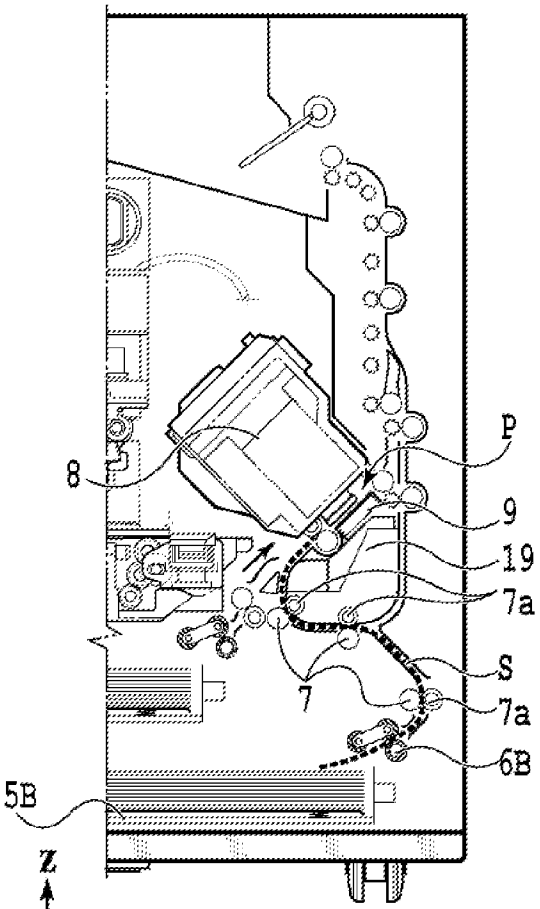

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
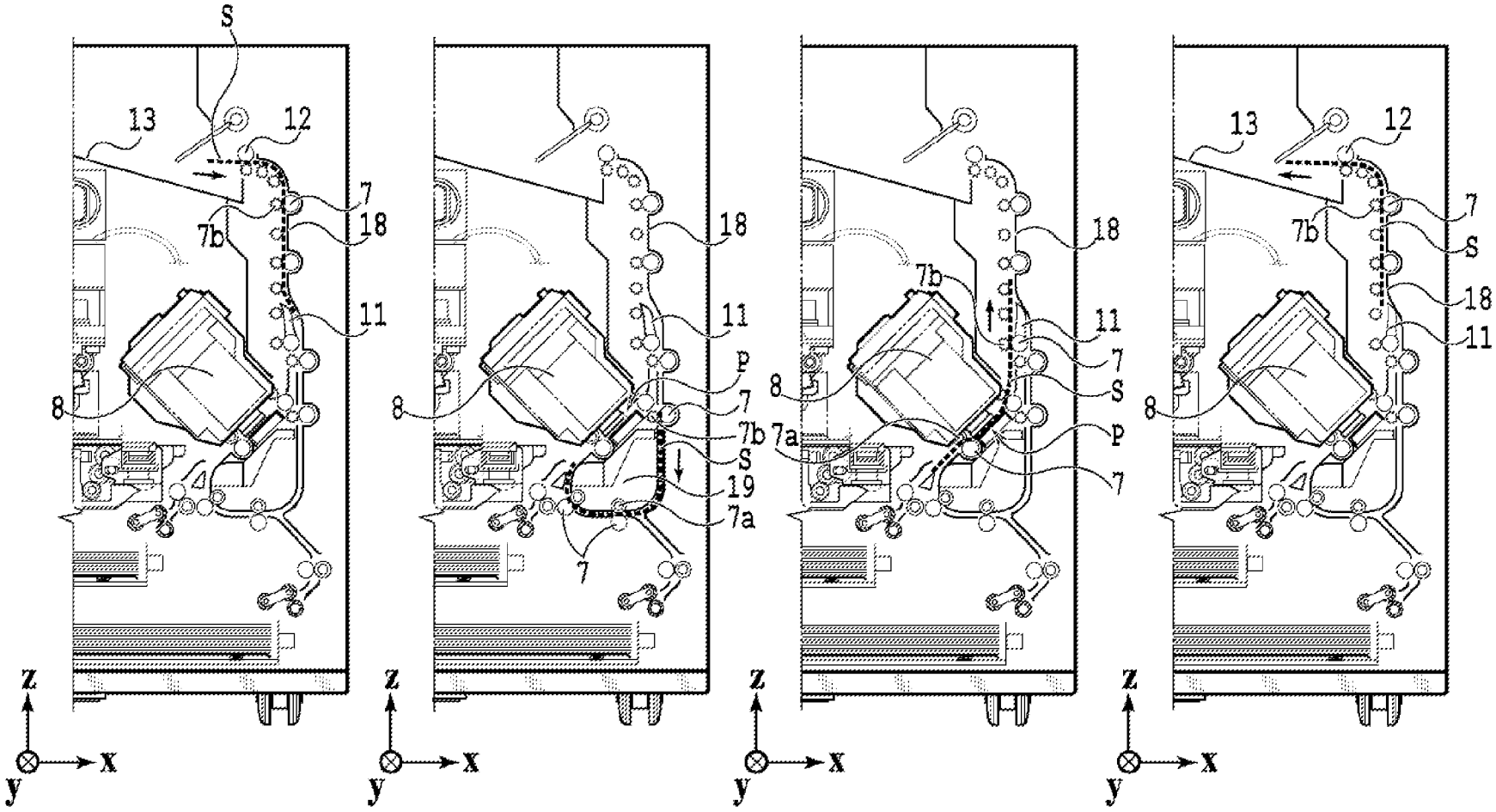
FIGS. 6A to 6D are diagrams illustrating the conveyance path in the case where print operation is performed on the back surface of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
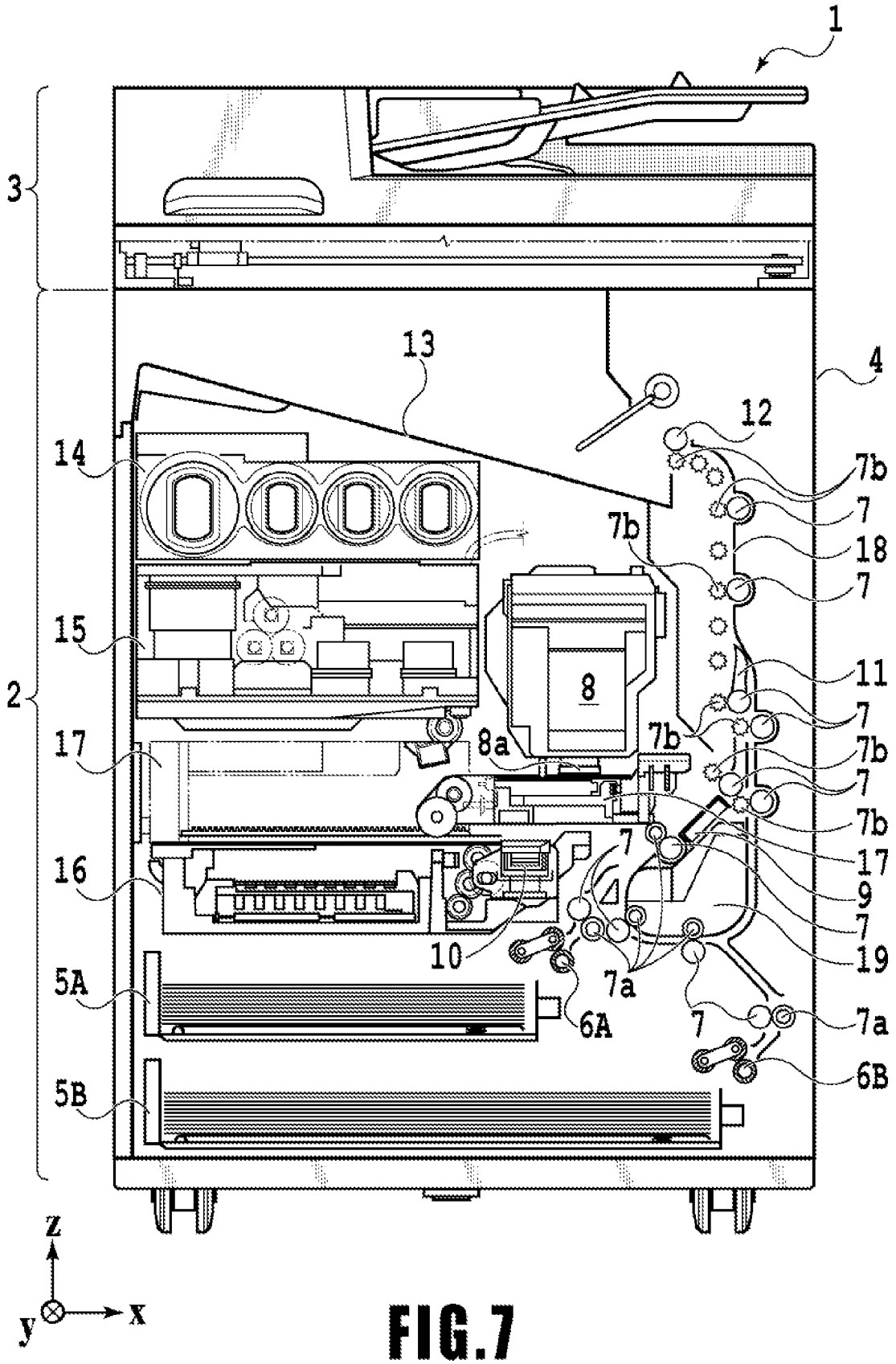
FIG. 7 is a diagram illustrating the printing apparatus in the maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8A:
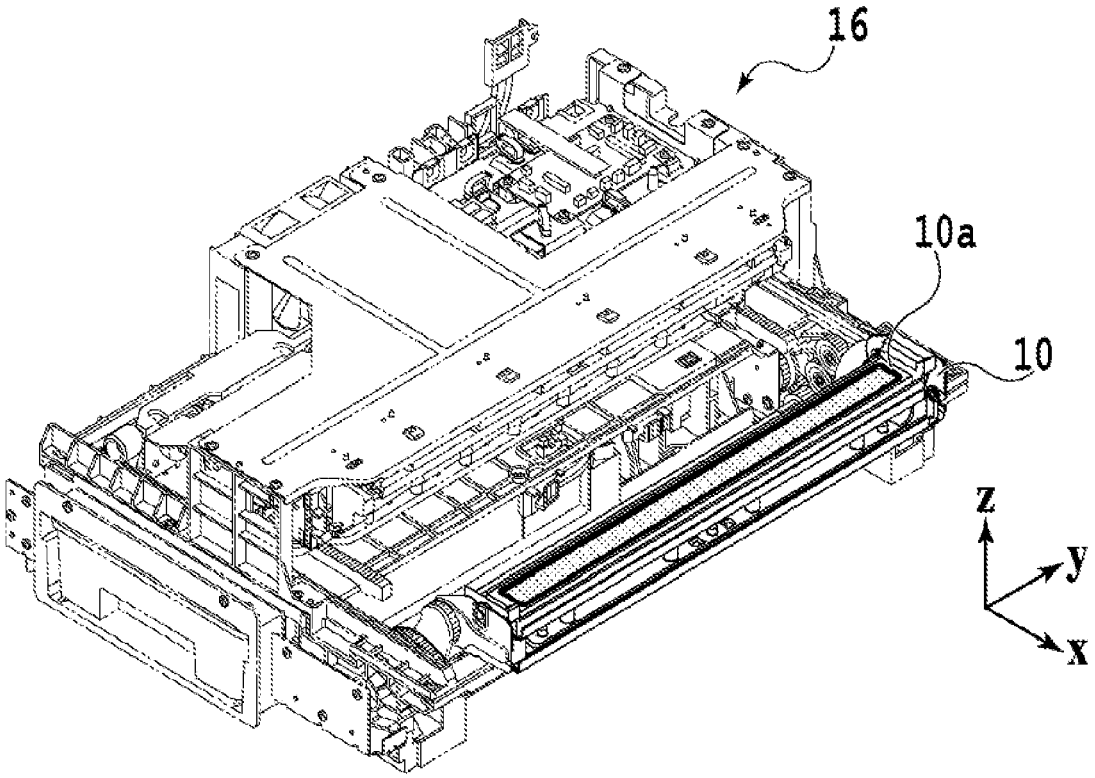
FIGS. 8A and 8B are perspective views of the structure of a maintenance unit.
Figure 8B:
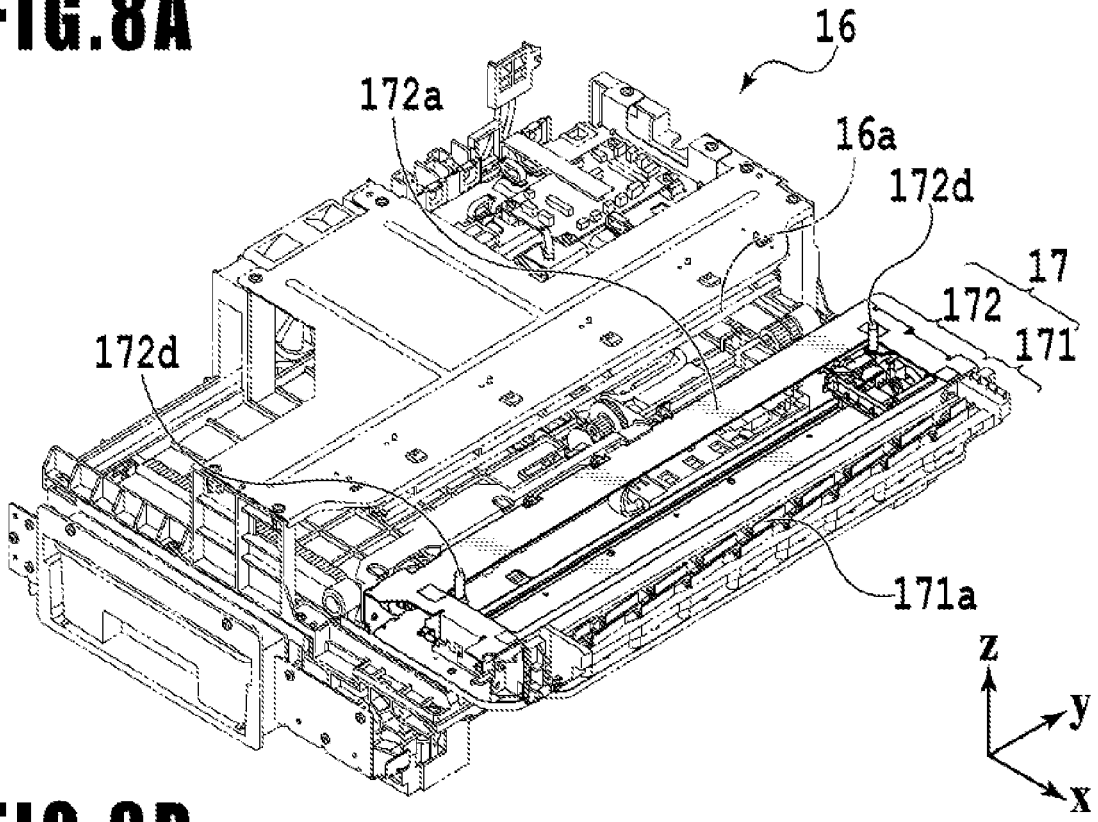

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction along the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction and an ejection inspecting unit 1700 movable in the y-direction within the opening. The ejection inspecting unit 1700 is provided with various mechanisms to perform the ejection inspection in addition to the vacuum wiper 1704.

Figure 9A:
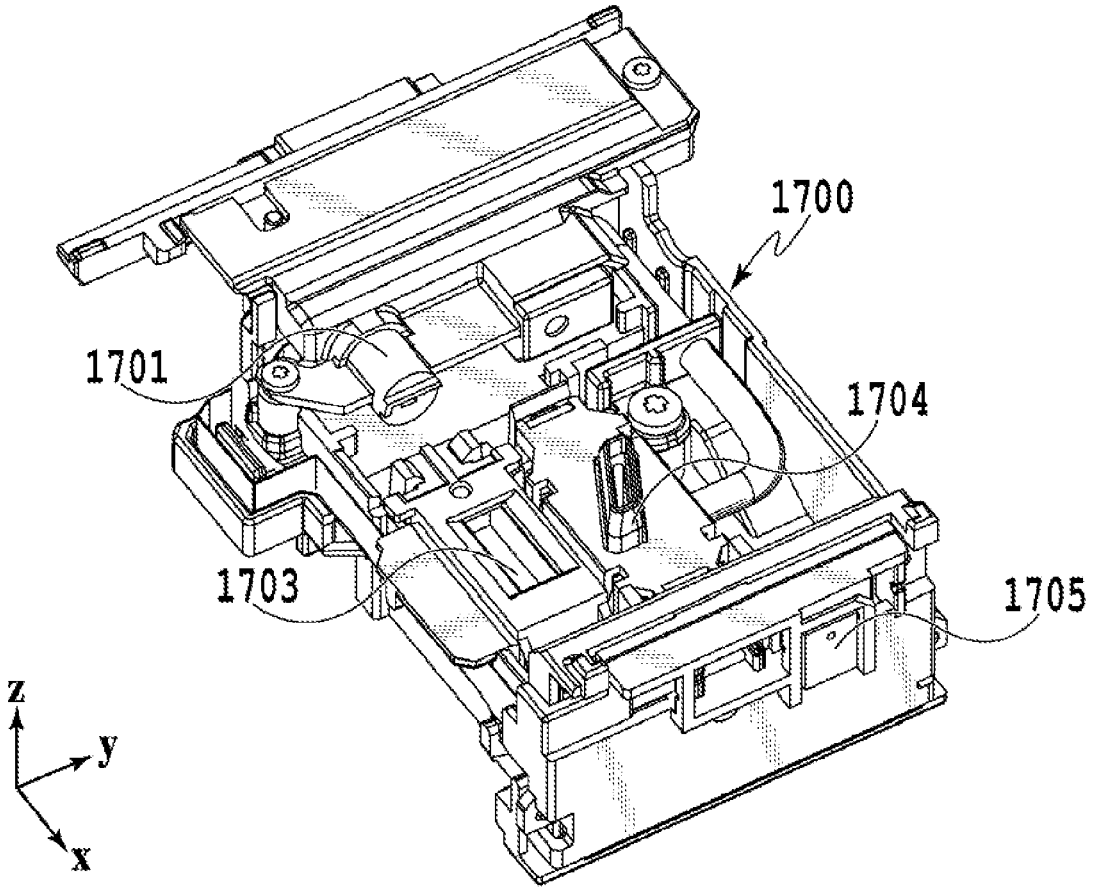
FIGS. 9A and 9B are diagrams illustrating the structure of an ejection inspecting unit 1700.
Figure 9B:
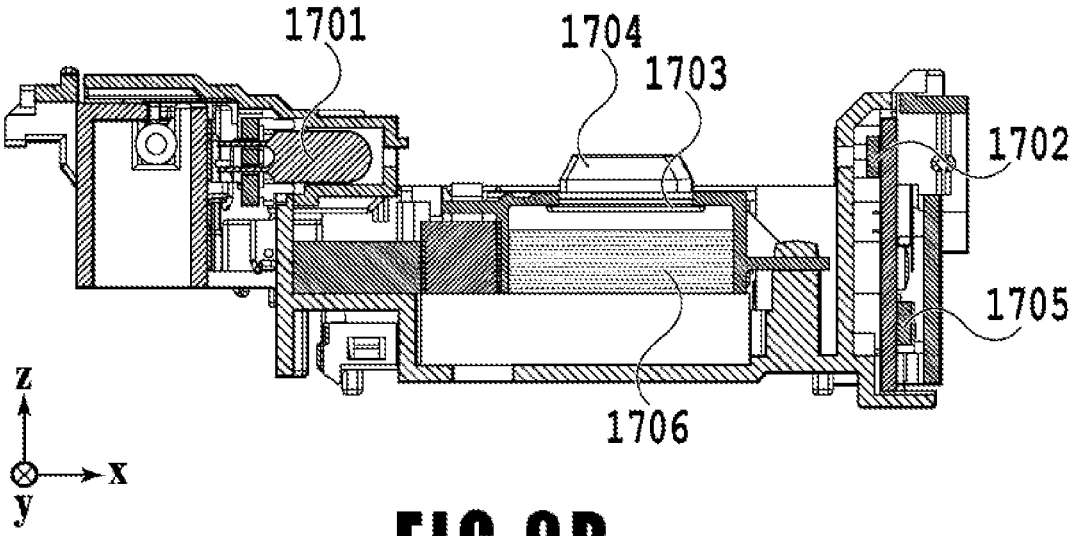

FIGS. 9A and 9B are diagrams illustrating the structure of the ejection inspecting unit 1700. FIG. 9A is a perspective view; FIG. 9B is a side view. The ejection inspecting unit 1700 is movable by being driven by a movement motor described later in the ±y direction. On a side of the ejection inspecting unit 1700 is disposed a linear encoder sensor 1705 for detecting the position of the ejection inspecting unit 1700 itself in movement. The box-shaped ejection inspecting unit 1700 has, in its inside, an ejection inspecting sensor 1720 (see FIG. 12) including a light emitting unit 1701 and a light receiving unit 1702, an opening 1703, the vacuum wiper 1704, and other parts.

The light emitted from the light emitting unit 1701, which is an LED, and traveling in the +x direction is received by the light receiving unit 1702, and the detection value of the light receiving unit 1702 is transmitted to the print controller 202. Vertically below the light path from the light emitting unit 1701 toward the light receiving unit 1702 is disposed the opening 1703 for receiving ejected ink droplets; further below the opening 1703 is housed an absorber 1706 for retaining the ink.

With the above structure, the print controller 202 in this embodiment aligns the ejection inspecting unit 1700 with the ejecting port to be inspected with the wiping unit 17 facing the ejecting port surface 8*a* and ejects ink continuously from the ejecting port. Then, the ejected droplets partially block the light path extending from the light emitting unit 1701 toward the light receiving unit 1702, making the detection value (voltage) of the light receiving unit 1702 smaller (the voltage change amount larger) than when the ejection operation is not being performed. However, in the case where the ejecting port being inspected cannot perform normal ejection operation, the light path extending from the light emitting unit 1701 toward the light receiving unit 1702 may not be blocked or the extent of the blocking may be small, so that the detection value of the light receiving unit 1702 will not be much different from the one at the time when the ejection operation is not being performed. In other words, the print controller 202 can make a failure/no-failure judgement on the ejection condition of the ejecting port being inspected, based on the amount of change in the detection value (voltage value) as described above.

Meanwhile, the vacuum wiper 1704 is capable of wiping the ejecting port surface 8*a* in they direction along with the movement of the ejection inspecting unit 1700. The vacuum wiper 1704 has, at its distal end, a suction port connected to a not illustrated suction pump. With this structure, when the ejection inspecting unit 1700 moves in the y direction with the suction pump in operation, ink and the like attached to the ejecting port surface 8*a* of the print head 8 are wiped by the vacuum wiper 1704 and sucked into the suction port.

Note that positioning pins 172*b* disposed at both ends of the flat plate 172*a* and the opening are used to align the ejecting port surface 8*a* with the ejection inspecting unit 1700 when ejection inspection or vacuum wiping by the vacuum wiper 1704 is performed.

Now, FIGS. 8A and 8B are referred to again. This embodiment is capable of a first wiping process which includes wiping operation by the blade wiper unit 171 but does not include wiping operation by the vacuum wiper 172 and a second wiping process including both wiping processes performed sequentially. To perform the first wiping process, the print controller 202, first, retreats the print head 8 vertically upward from the maintenance position illustrated in FIG. 7 and, in this state, pulls out the wiping unit 17 from the maintenance unit 16. Then, after moving the print head 8 vertically downward to a position where the print head 8 can come into contact with the blade wipers 171*a*, the print controller 202 moves the wiping unit 17 into the maintenance unit 16. Along with this movement, ink and the like attached to the ejecting port surface 8*a* are wiped off by the blade wipers 171*a*. In other words, the blade wipers 171*a* wipe the ejecting port surface 8*a* during the movement into the maintenance unit 16 from the position where the blade wipers 171*a* are pulled out from the maintenance unit 16.

When the blade wiper unit 171 is housed, the print controller 202, next, moves the cap unit 10 vertically upward and brings the cap member 10*a* into close contact with the ejecting port surface 8*a* of the print head 8. Then, the print controller 202, in this state, drives the print head 8 such that the print head 8 performs preliminary ejection and causes the suction pump to suck the ink collected in the cap member 10*a*.

On the other hand, to perform the second wiping process, the print controller 202, first, retreats the print head 8 vertically upward from the maintenance position illustrated in FIG. 7 and, in this state, slides out the wiping unit 17 from the maintenance unit 16. Then, after moving the print head 8 vertically downward to a position where the print head 8 can come into contact with the blade wipers 171*a*, the print controller 202 moves the wiping unit 17 into the maintenance unit 16. Along with this movement, the blade wipers 171*a* perform the wiping operation for the ejecting port surface 8*a*. Next, the print controller 202 retreats the print head 8 vertically upward again from the maintenance position illustrated in FIG. 7 and, in this state, slides out the wiping unit 17 from the maintenance unit 16 to a specified position. Next, while moving the print head 8 down to the wiping position illustrated in FIG. 7, the print controller 202 positions the ejecting port surface 8*a* and the vacuum wiper unit 172 to each other using the flat plate 172*a* and the positioning pins 172*b*. After that, the print controller 202 performs the wiping operation by the vacuum wiper unit 172 as described above. After retreating the print head 8 vertically upward and making the wiping unit 17 to be housed, the print controller 202, as in the first wiping process, performs the preliminary ejection by the cap unit 10 into the cap member and the suction operation for collected ink.

Figure 10:
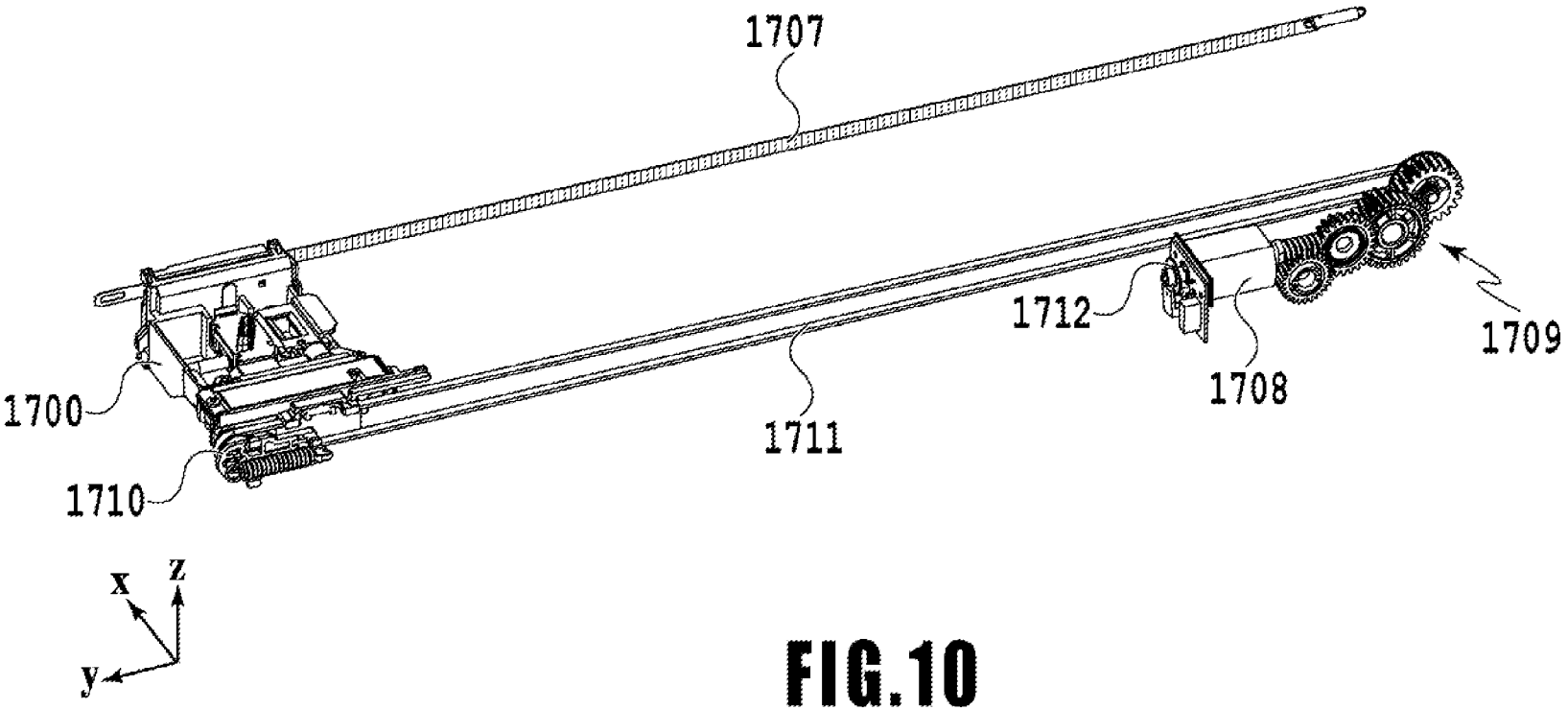
FIG. 10 is a diagram illustrating a movement mechanism of the ejection inspecting unit.

FIG. 10 is a diagram illustrating a movement mechanism of the ejection inspecting unit 1700. The driving force of the movement motor 1708 is transmitted to a gear train 1709, rotating a belt 1711 stretched around the gear train 1709 and a pulley 1710. The belt 1711 extends in the y direction by the distance corresponding to the ejecting port surface 8*a* of the print head 8, which is the inspection target, and the ejection inspecting unit 1700 is fixed to a portion of the belt 1711. With this structure, when the print controller 202 rotates the movement motor 1708 in the forward or reverse direction, the ejection inspecting unit 1700 moves back and forth in the ±y direction.

A linear scale 1707 is a scale for managing the position of the ejection inspecting unit 1700 in the y direction. The linear scale 1707 has multiple slits formed at a pitch of approximately 0.17 mm and extends in the y direction at a height facing the linear encoder sensor 1705 illustrated in FIG. 9A. With this structure, the print controller 202 can know the position of the ejection inspecting unit 1700 in the y direction in steps of 0.17 mm by counting the number of times the linear encoder sensor 1705 detects a slit.

Figure 11:
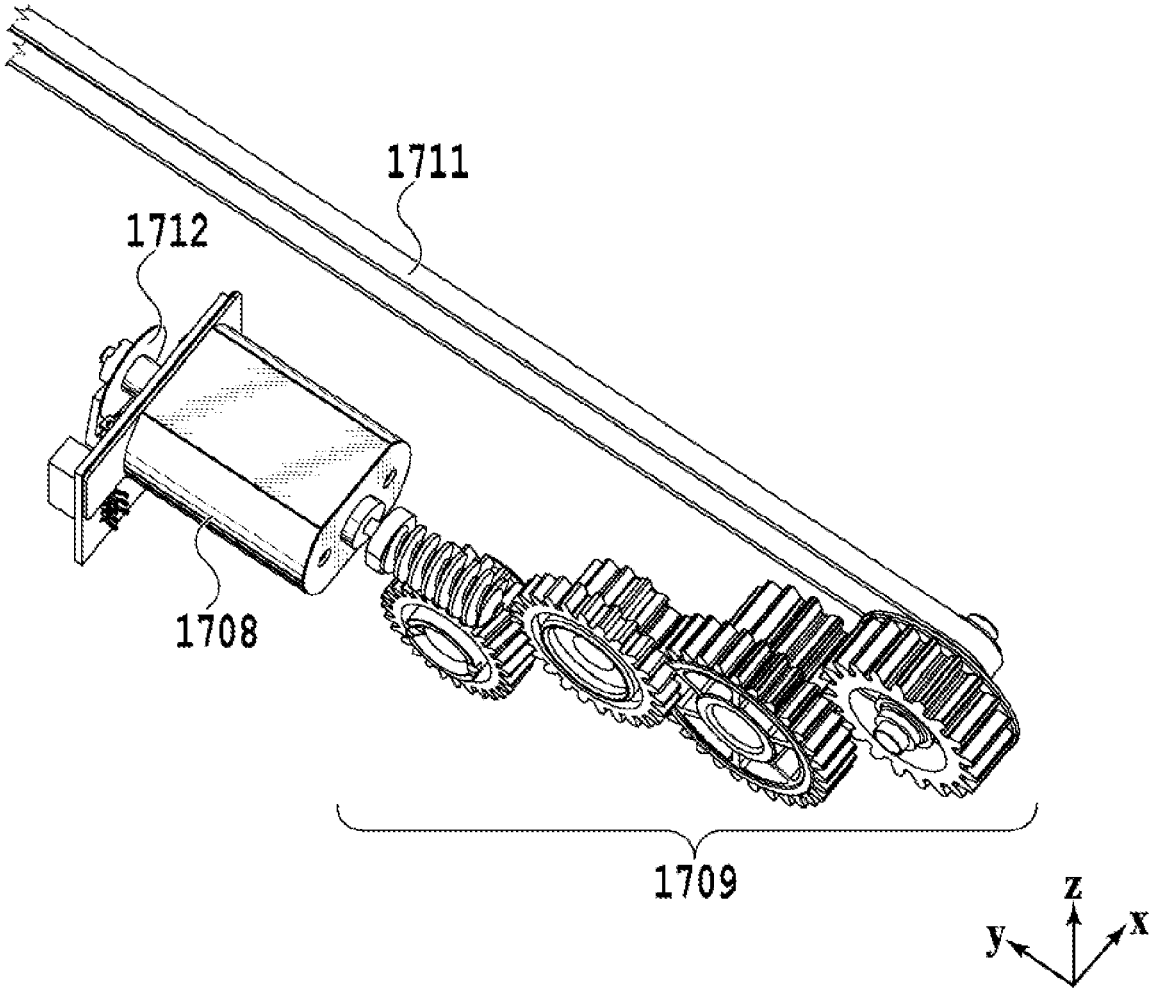
FIG. 11 is an enlarged view of the periphery of a movement motor.

FIG. 11 is an enlarged view of the periphery of the movement motor 1708. To the movement motor 1708 is attached a rotary encoder 1712, from which the print controller 202 can also detect the speed and position of the ejection inspecting unit 1700.

The gear train 1709 for transmitting the driving force of the movement motor 1708 to the belt 1711 includes a worm gear and multiple spur gears to reduce the rotation speed of the movement motor 1708 to a speed appropriate for the movement of the ejection inspecting unit 1700. In this embodiment, the rotation speed of the movement motor 1708 and the arrangement of the gear train 1709 are adjusted such that the movement speed of the ejection inspecting unit 1700 is at approximately 1 mm/second.

With this setting in this embodiment, the positional information on the ejection inspecting unit 1700 obtained from the rotary encoder 1712 has higher resolution than that obtained from the linear encoder. Specifically, the positional information on the ejection inspecting unit 1700 obtained from the linear encoder is in steps of approximately 0.17 mm, while the positional information on the ejection inspecting unit 1700 obtained from the rotary encoder 1712 is in steps of approximately $0.92\times10^{-3}$ mm. In other words, this embodiment in which the driving force of the movement motor 1708 is transmitted via the reduction gear train 1709, and the movement motor 1708 is controlled based on the rotary encoder 1712 is capable of controlling the speed of the ejection inspecting unit 1700 with higher accuracy than conventional ones.

Figure 12:
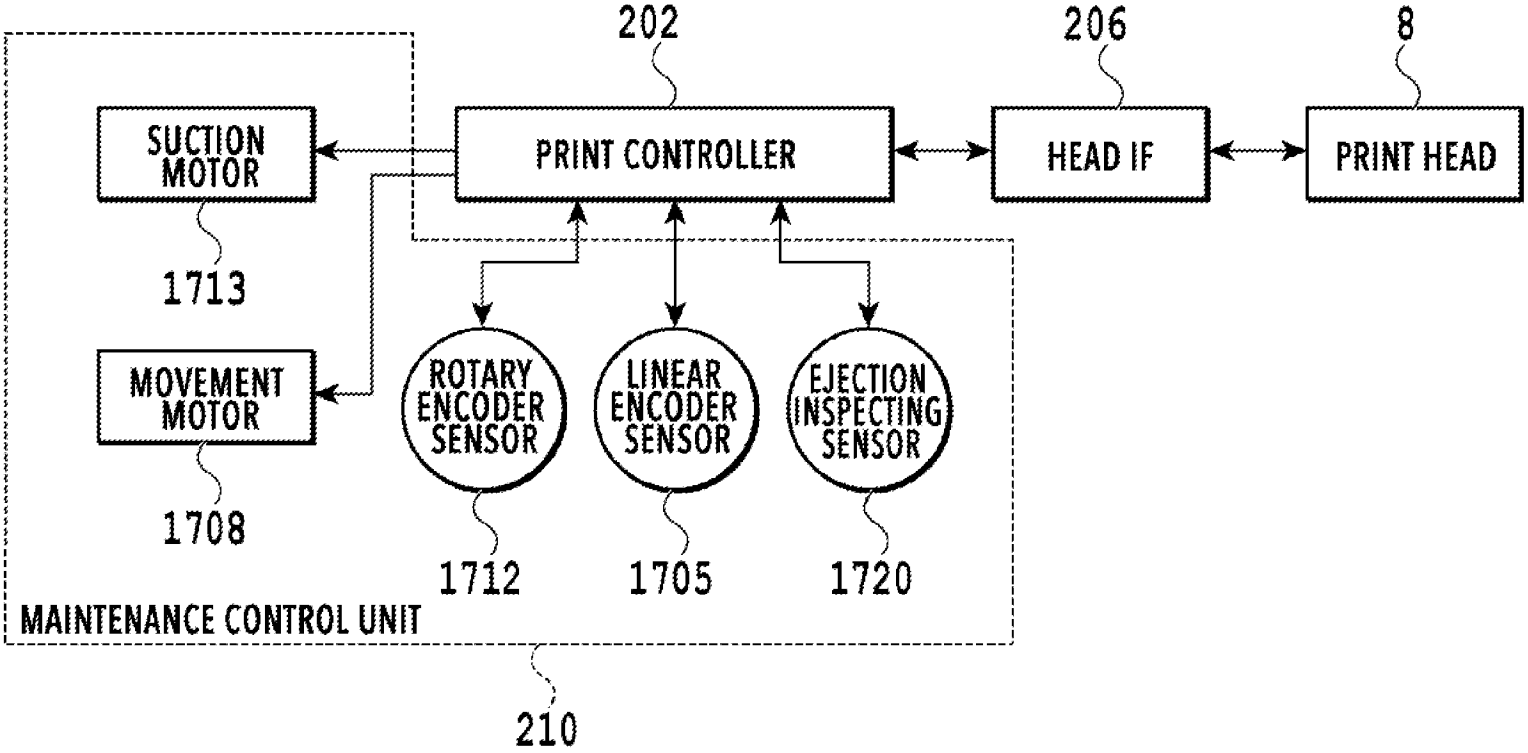
FIG. 12 is a block diagram for describing in detail the control configuration concerning an ejection inspection process.

FIG. 12 is a block diagram for describing in detail the control configuration concerning the ejection inspection process in this embodiment. The maintenance control unit 210 includes a suction motor 1713 for operating the suction pump during the vacuum wiping and the movement motor 1708 for moving the ejection inspecting unit 1700 in the y direction, and these are controlled by the print controller 202. The maintenance control unit 210 also includes the ejection inspecting sensor 1720 including the light emitting unit 1701 and the light receiving unit 1702 described with reference to FIGS. 9A and 9B, the linear encoder sensor 1705, and the rotary encoder 1712. During the ejection inspection process, the print controller 202 drives and controls the movement motor 1708, drives the print head 8, and performs other operations based on the detection results of these sensors.

In the ejection inspection process, the print controller 202 performs ejection operation at a predetermined frequency from the ejecting ports located in the inspectable area of the ejection inspecting sensor 1720 and acquires the detection results. The print controller 202 repeats such a process on multiple ejecting ports in order while moving the ejection inspecting unit 1700. During this operation, the print controller 202 performs control on driving the movement motor 1708, in other words, the movement speed of the ejection inspecting unit 1700, based on the detection result of the rotary encoder 1712. Specifically, the print controller 202 can move the ejection inspecting unit 1700 stably at a sufficiently low speed of 1 mm/second.

In addition, the print controller 202 controls the timing when the print head 8, in other words, each ejecting port performs ejection operation, based on the detection result of the linear encoder sensor 1705. The ejection inspecting sensor 1720 in this embodiment has an inspectable area of ±0.3 mm centered on the optical axis extending from the light emitting unit 1701 toward the light receiving unit 1702. Thus, as long as droplets ejected from the ejecting port being inspected pass through this inspectable area, the relative position of the ejecting port with respect to the ejection inspecting sensor 1720 may be slightly shifted, and alignment at such a high resolution as the rotary encoder 1712 has is not necessary. On the other hand, what number ejecting port from the beginning each ejecting port being inspected is among the arrayed ejecting ports needs to be accurately managed without an error. For this reason, in this embodiment, the timing when each ejecting port performs ejection operation is controlled based on the detection results of the linear encoder sensor 1705, in other words, the position coordinate in the y direction, instead of the detection results of the rotary encoder 1712.

However, since both the linear scale 1707 and the ejecting port array have fine pitches, the individual difference of each device or the installation environment may cause a misalignment between them. For this reason, in this embodiment, to improve the reliability of the count value obtained from the linear encoder sensor 1705, a process to align the linear scale 1707 and the print head 8 with each other in the y direction is performed prior to the actual ejection inspection process.

Figure 13:
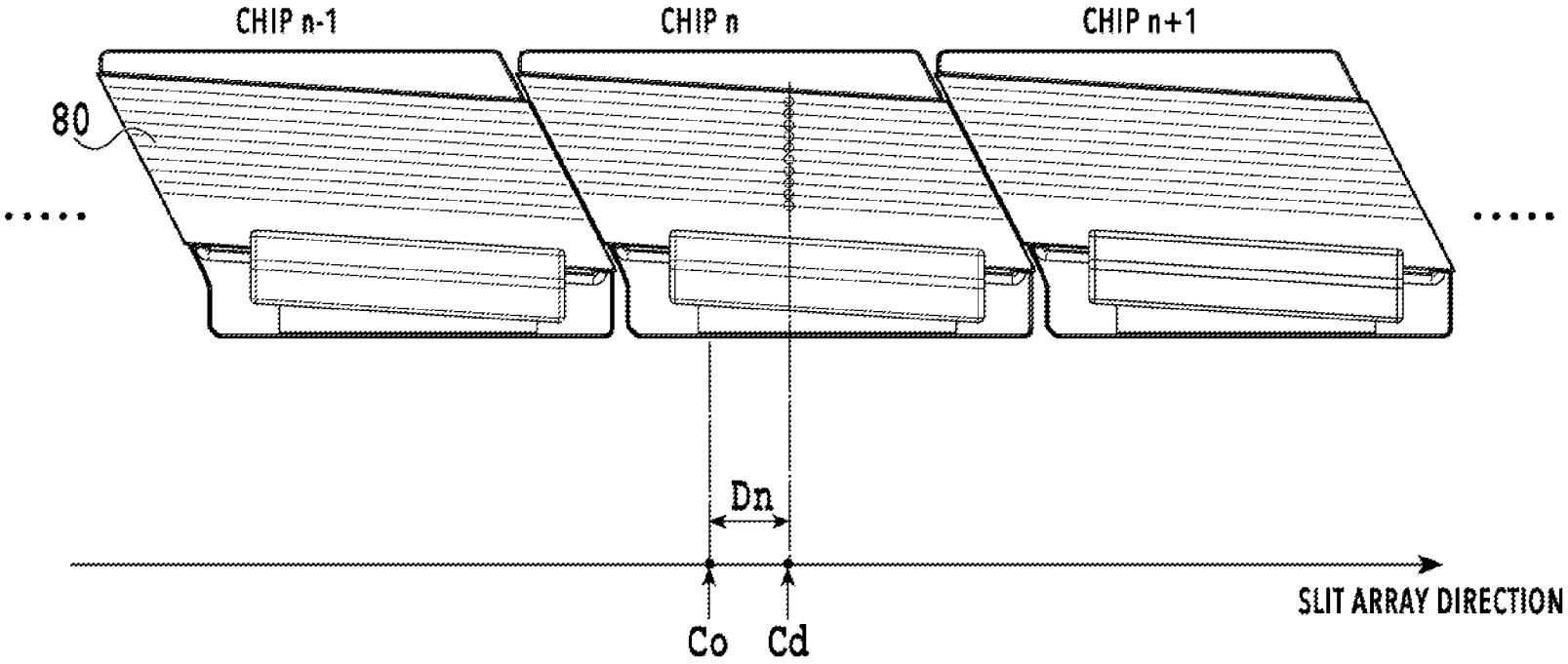
FIG. 13 is a diagram illustrating ejecting port arrays, for describing an alignment process.

FIG. 13 is a diagram illustrating the ejecting port array for describing the alignment process. On the ejecting port surface 8*a*, multiple identical chips each serving as an ejecting unit including a specified number of arrayed ejecting ports are aligned in the y direction. FIG. 13 is an enlarged view of three consecutive chips 80: the (n−1)-th, the (n)-th, and the (n+1)-th from an end. Each chip 80 has ten ejecting port arrays arranged in the x direction, each ejecting port array including multiple ejecting ports configured to eject the same kind of ink and aligned in they direction.

In the alignment process, the print controller 202 causes multiple ejecting ports positioned at approximately the same position in the y direction among the multiple ejecting ports included in one chip (the chip n in the figure), to perform continuous ejection operation at a predetermined frequency. In addition, during this continuous ejection operation, the print controller 202 drives the movement motor 1708 to move the ejection inspecting unit 1700 at a predetermined speed. Then, while detecting the output values of the ejection inspecting sensor 1720, the print controller 202 counts the number of slits of the linear scale 1707 that the linear encoder sensor 1705 passes by from the origin and acquires count value Cd at which the ejection inspecting sensor 1720 detects continuous ejection operation. Further, the print controller 202 calculates difference Dn (Dn=Cd−Co), where Cd is an actually measured count value of the ejecting ports that were caused to perform ejection operation, and Co is the designed count value. Then, the print controller 202 stores the calculation result as a correction value Dn for the chip n. The print controller 202 performs such a process once for every chip.

After that, when the print controller 202 actually performs the ejection inspection process, the print controller 202 drives the print head 8 via the head I/F 206 such that ink is ejected from the ejecting ports being inspected. The print controller 202 adds the correction value Dn to the count value Co in design, of the ejecting port being inspected to calculate the corrected count value Cm, and aligns the ejection inspecting sensor 1720 with the position where the count value of the linear encoder sensor 1705 agrees with the corrected count value Cm. In a case where the ejection inspecting sensor 1720 detects ejection of droplets in this state, the print controller 202 determines that the ejection condition of the ejecting port being inspected is favorable (no-failure). On the other hand, in a case where the ejection inspecting sensor 1720 does not detect ejection of droplets, the print controller 202 determines that the ejection condition of the ejecting port being inspected is defective (failure). Then, such failure/no-failure information on the ejection condition is associated with the position of the ejecting port and stored in memory. The print controller 202 performs the ejection inspection and stores the failure/no-failure information of the ejection condition described above sequentially for all the ejecting ports of all the chips n while moving the ejection inspecting sensor 1720 at a low speed (1 mm/second).

Note that although in the alignment process described above, the correction value Dn is acquired for every chip, this embodiment is not limited to such a configuration. For example, the correction value Dn may be acquired for every several chips or a part of chips in the center. Reduction of the number of chips for which the correction values are obtained reduces the time required for the alignment process.

In addition, the alignment process does not necessarily have to be performed for every ejection inspection process. For example, the alignment process may be performed only when the ejection inspection process is performed for the first time after the delivery of a printing apparatus, or it may be performed every several ejection inspection processes. In the case where misalignment of the relative position between the linear scale and the ejecting port array of the print head does not occur, the alignment process itself does not have to be prepared.

In this embodiment, the information stored in the ejection inspection process may be utilized in any way afterward. For example, in a case where some ejecting ports are determined to be defective in ejection operation in the ejection inspection process, the vacuum wiping may be performed subsequently after the ejection inspection process. Alternatively, when printing an image next time, ejection data assigned to the ejecting ports determined to be defective in ejection operation may be reassigned to other ejecting ports determined not to be defective in ejection operation.

Even in the print head 8 that had performed normal ejection operation before shipment, the ejection performance may deteriorate as the print operation continues. By preparing an ejection inspection process that allows the ejection performance of the print head to be inspected after the delivery of the printing apparatus and making it possible to perform this process at appropriate times as in this embodiment, the inspection results can be utilized in the next print operation, stabilizing the image quality.

Note that in the configuration in which the rotary encoder and the linear encoder work cooperatively for the ejection inspection process as in this embodiment, the ratio between the slit interval of the rotary encoder and the slit interval of the linear encoder can be used to check the operation of each encoder. Specifically, in the case where the ratio between the count value of slits in the rotary encoder and the count value of slits in the linear encoder is deviated from the designed value, it can be judged that incorrect detection has occurred in at least one of these encoders and that an inspection error has occurred. Possible causes of the incorrect detection include ink or grease attached to the encoders and tooth jumping of the drive belt.

Further, although the ejection inspecting sensor 1720 used in the above has the light emitting unit and the light receiving unit facing each other, a reflective sensor having a light emitting unit and a light receiving unit on the same side may be used instead of the ejection inspecting sensor in the above embodiment.

As has been described above, in the configuration in which the ejection condition of each ejecting port is inspected while moving the ejection inspecting unit in the direction in which the ejecting ports are arrayed, this embodiment stabilizes the movement of the ejection inspecting unit at a low speed, making possible to acquire detection results with high reliability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-068518 filed Mar. 30, 2018, which is hereby incorporated by reference herein in its entirety.

What is claimed is:

1. An inkjet printing apparatus comprising:

a print head in which multiple ejecting ports for ejecting ink are arrayed in a first direction;

an inspection unit including a sensor configured to inspect an ejection condition of the multiple ejecting ports;

a motor configured to move the inspection unit in the first direction;

a conversion unit configured to reduce rotation speed obtained from the motor and to convert driving force of the motor into movement of the inspection unit in the first direction;

a rotary encoder configured to detect rotation of the motor;

a linear encoder configured to detect a position of the inspection unit along the first direction; and a control unit configured to control movement speed of the inspection unit based on the detection by the rotary encoder, and to control a relative position between the inspection unit and the multiple ejecting ports based on the detection by the linear encoder.

2. The inkjet printing apparatus according to claim 1, wherein while causing an ejecting port, among the multiple ejecting ports, positioned in an inspectable area of the inspection unit to eject ink, the control unit inspects the ejection condition of the ejecting port using the inspection unit.

3. The inkjet printing apparatus according to claim 2, wherein the control unit makes a determination on the ejection condition of the ejecting port based on change in an output value of the sensor, the change being caused by ink ejected from the ejecting port, passing across a light path extending from a light emitting unit of the sensor toward a light receiving unit of the sensor.

4. The inkjet printing apparatus according to claim 1, wherein before inspecting the print head, the control unit, while causing a specified ejecting port among the multiple ejecting ports to eject ink, drives the motor to move the inspection unit in the first direction and adjusts a position of the inspection unit based on a detection value of the linear encoder at the time when the inspection unit detects the ejection and a count value for the specified ejecting port.

5. The inkjet printing apparatus according to claim 1, wherein the print head includes multiple ejecting ports so as to correspond to a width of the print medium.

6. The inkjet printing apparatus according to claim 1, wherein the inspection unit further includes a maintenance unit configured to perform maintenance on the multiple ejecting ports.

7. The inkjet printing apparatus according to claim 6, wherein the maintenance unit includes a mechanism that is configured to come into contact with a surface in which the multiple ejecting ports are arrayed and is capable of sucking ink from the multiple ejecting ports.

8. The inkjet printing apparatus according to claim 6, wherein in a case where the control unit determines based on a result of the inspection of the print head that there is an ejecting port whose ejection condition is defective, the control unit causes the maintenance unit to perform maintenance on the multiple ejecting ports while moving the inspection unit.

9. The inkjet printing apparatus according to claim 1, wherein the control unit determines whether the inspection includes an error, based on ratio between a count value obtained by counting a slit in the rotary encoder and a count value obtained by counting a slit in the linear encoder.

10. A control method of controlling an inkjet printing apparatus including (a) a print head in which multiple ejecting ports for ejecting ink are arrayed in a first direction, (b) an inspection unit including a sensor configured to inspect an ejection condition of the multiple ejecting ports, (c) a motor configured to move the inspection unit in the first direction, (d) a conversion unit configured to reduce rotation speed obtained from the motor and to convert driving force of the motor into movement of the inspection unit in the first direction, (e) a rotary encoder configured to detect rotation of the motor, and (f) a linear encoder configured to detect a position of the inspection unit along the first direction, the control method comprising:

a control step of controlling movement speed of the inspection unit based on the detection by the rotary encoder, and of controlling a relative position between the inspection unit and the multiple ejecting ports based on the detection by the linear encoder.

11. The control method according to claim 10, wherein in the control step, while an ejecting port, among the multiple ejecting ports, positioned in an inspectable area of the inspection unit is being caused to eject ink, the ejection condition of the ejecting port is inspected using the inspection unit.

12. The control method according to claim 11, wherein in the control step, a determination on the ejection condition of the ejecting port is made based on change in an output value of the sensor, the change being caused by ink ejected from the ejecting port, passing across a light path extending from a light emitting unit of the sensor toward a light receiving unit of the sensor.

13. The control method according to claim 10, wherein in the control step, before the print head is inspected, while a specified ejecting port among the multiple ejecting ports is being caused to eject ink, the motor is driven to move the inspection unit in the first direction, and a position of the inspection unit is adjusted based on a detection value of the linear encoder at the time when the inspection unit detects the ejection and a count value for the specified ejecting port.

14. The control method according to claim 10, wherein the print head includes multiple ejecting ports so as to correspond to a width of the print medium.

15. The control method according to claim 10, wherein the inspection unit further includes a maintenance unit configured to perform maintenance on the multiple ejecting ports.

16. The control method according to claim 15, wherein the maintenance unit includes a mechanism that is configured to come into contact with a surface in which the multiple ejecting ports are arrayed and is capable of sucking ink from the multiple ejecting ports.

17. An inspection apparatus that inspects an inspection target while moving an inspection unit including a sensor for inspection relative to the inspection target extending in a first direction, the inspection apparatus comprising:

a motor configured to move the inspection unit in the first direction;

a conversion unit configured to reduce rotation speed obtained from the motor and to convert driving force of the motor into movement of the inspection unit in the first direction;

a rotary encoder configured to detect rotation of the motor;

a linear encoder configured to detect a position of the inspection unit along the first direction; and a control unit configured to control movement speed of the inspection unit based on the detection by the rotary encoder, and to control a relative position between the inspection unit and the inspection target based on the detection by the linear encoder.

* * * * *